US011692710B2

(12) United States Patent
Tada

(10) Patent No.: US 11,692,710 B2
(45) **Date of Patent: *Jul. 4, 2023**

(54) BURNER, COMBUSTOR INCLUDING SAME, AND GAS TURBINE

(71) Applicant: Mitsubishi Power, Ltd., Kanagawa (JP)

(72) Inventor: Katsuyoshi Tada, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/419,386

(22) PCT Filed: Jan. 22, 2020

(86) PCT No.: PCT/JP2020/002042

§ 371 (c)(1),
(2) Date: Jun. 29, 2021

(87) PCT Pub. No.: WO2020/158528

PCT Pub. Date: Aug. 6, 2020

(65) Prior Publication Data

US 2022/0074347 A1 Mar. 10, 2022

(30) Foreign Application Priority Data

Jan. 31, 2019 (JP) ..... 2019-015574

(51) Int. Cl.
*F23R 3/28* (2006.01)
*F23D 11/40* (2006.01)
(Continued)

(52) U.S. Cl.
CPC ..... *F23R 3/286* (2013.01); *F23D 11/40* (2013.01); *F23D 14/22* (2013.01); *F23D 14/64* (2013.01); *F23R 3/10* (2013.01)

(58) Field of Classification Search
CPC ..... F23R 3/045; F23R 3/286; F23R 3/283; F23R 3/30; F23R 3/32; F23R 3/002;
(Continued)

(56) References Cited

U.S. PATENT DOCUMENTS 5,251,447 A 10/1993 Joshi
5,407,347 A * 4/1995 Bortz ..... F23D 14/02 431/354
(Continued)

FOREIGN PATENT DOCUMENTS

CN 1715758 1/2006
CN 1732360 2/2006
(Continued)

OTHER PUBLICATIONS

International Search Report dated Mar. 24, 2020 in International Application No. PCT/JP2020/002042, with English Translation.
(Continued)

*Primary Examiner* — Stephanie Sebasco Cheng
*Assistant Examiner* — Jingchen Liu
(74) *Attorney, Agent, or Firm* — Wenderoth, Lind & Ponack, L.L.P.

(57) ABSTRACT

A burner comprises: at least one mixing tube extending inside a fuel plenum and having an interior configured to be supplied with an air; and a plurality of fuel injection holes for injecting a fuel supplied to the fuel plenum into the interior of the at least one mixing tube. When the at least one mixing tube is viewed in an axial direction of the mixing tube, a central axis of each of the plurality of fuel injection holes is oblique in a same direction with respect to a circumferential direction of the mixing tube, to a radial direction of the mixing tube.

8 Claims, 9 Drawing Sheets

(51) Int. Cl.
*F23R 3/10* (2006.01)
*F23D 14/64* (2006.01)
*F23D 14/22* (2006.01)

(58) Field of Classification Search
CPC ..... F23R 2900/03043–03045; F23D 14/64; F23D 14/22; F23D 14/82; F23D 2900/31019; F23D 3/14; F23D 3/22; F23D 11/102–103; F23D 11/40–408; F23D 14/02–105; F23D 14/32; F23D 14/62–64; F23D 2203/002; F23D 2203/007; F23D 2900/00003; F23D 2900/14002; F23D 2900/14021; F23D 2900/14241; F23D 2900/14642; F23D 2900/14701; F02C 7/224; F01D 9/023; F01D 9/06
See application file for complete search history.

(56) References Cited

U.S. PATENT DOCUMENTS

| | | | | |
|---|---|---|---|---|
| 6,623,267 | B1 * | 9/2003 | Golladay, Jr. | F23D 14/46 431/352 |
| 7,003,958 | B2 | 2/2006 | Dinu et al. | |
| 8,104,284 | B2 | 1/2012 | Miura et al. | |
| 8,424,311 | B2 | 4/2013 | York et al. | |
| 8,539,773 | B2 | 9/2013 | Ziminsky et al. | |
| 8,616,002 | B2 * | 12/2013 | Kraemer | F23N 5/082 60/737 |
| 9,506,654 | B2 * | 11/2016 | Uhm | F23D 14/82 |
| 10,712,009 | B2 * | 7/2020 | Baumann | F23R 3/28 |
| 2002/0014078 | A1 | 2/2002 | Mandai | |
| 2002/0192615 | A1 * | 12/2002 | Moriya | F23D 14/02 431/278 |
| 2006/0000216 | A1 | 1/2006 | Dinu et al. | |
| 2008/0276618 | A1 | 11/2008 | Poyyapakkam | |
| 2010/0192581 | A1 | 8/2010 | Ziminsky et al. | |
| 2010/0218501 | A1 | 9/2010 | York et al. | |
| 2010/0248171 | A1 | 9/2010 | Hayashi et al. | |
| 2011/0197587 | A1 * | 8/2011 | Zuo | F23D 14/02 239/398 |
| 2013/0074510 | A1 | 3/2013 | Berry | |
| 2013/0174568 | A1 | 7/2013 | Uhm et al. | |
| 2013/0219899 | A1 | 8/2013 | Uhm | |
| 2013/0232979 | A1 | 9/2013 | Singh | |
| 2014/0013756 | A1 * | 1/2014 | Melton | F02C 7/22 60/725 |
| 2014/0157779 | A1 * | 6/2014 | Uhm | F23R 3/10 60/725 |
| 2014/0338339 | A1 | 11/2014 | Westmoreland et al. | |
| 2014/0338340 | A1 | 11/2014 | Melton et al. | |
| 2016/0102863 | A1 | 4/2016 | Yoshino | |
| 2021/0088216 | A1 * | 3/2021 | Tada | F02C 7/22 |
| 2021/0102703 | A1 | 4/2021 | Tada et al. | |
| 2022/0381184 | A1 * | 12/2022 | Fukuba | F23D 14/02 |

FOREIGN PATENT DOCUMENTS

| | | |
|---|---|---|
| JP | 61-153404 | 7/1986 |
| JP | 9-303716 | 11/1997 |
| JP | 2004-170010 | 6/2004 |
| JP | 2006-17381 | 1/2006 |
| JP | 2008-281329 | 11/2008 |
| JP | 2009-74706 | 4/2009 |
| JP | 2010-181137 | 8/2010 |
| JP | 2010-203758 | 9/2010 |
| JP | 2014-173837 | 9/2014 |
| JP | 2014-238254 | 12/2014 |
| JP | 2016-80214 | 5/2016 |
| JP | 2018-189285 | 11/2018 |

OTHER PUBLICATIONS

International Preliminary Report on Patentability dated Aug. 12, 2021 in International Application No. PCT/JP2020/002042, with English Translation.
International Search Report dated Apr. 16, 2019 in International (PCT) Application No. PCT/JP2019/002217 with English-language translation.
English translation of the International Preliminary Report on Patentability and Written Opinion of the International Searching Authority dated Oct. 8, 2020 in International Application No. PCT/JP2019/002217.
Office Action dated Jan. 28, 2022 in Chinese Application No. 201980019938.9.

* cited by examiner

BURNER, COMBUSTOR INCLUDING SAME, AND GAS TURBINE

TECHNICAL FIELD

This disclosure relates to a burner, a combustor including the same, and a gas turbine.

BACKGROUND

In a combustor of a gas turbine, etc., a premix burner using a swirler to impart swirl to the fuel and air flow is sometimes used in order to reduce nitrogen oxides (NOx) produced during combustion. However, in the burner using such a swirler, backfires can easily occur due to the vortex core formed by the swirler when the combustion temperature is high or when a fast burning fuel (e.g., hydrogen) is used. Therefore, a burner that can achieve low NOx without using a swirler has been proposed.

For example, Patent Document 1 discloses a fuel/air mixing device (burner) for use in a combustor of a gas turbine. This fuel/air mixing device is provided with a premixed disk including a pair of wall surfaces disposed with a distance in the axial direction and a fuel plenum formed between the wall surfaces, and a plurality of mixing tubes extending through the premixed disk. Each mixing tube has a plurality of through holes. Fuel in the fuel plenum is injected into each mixing tube through the plurality of through holes. Further, air is supplied to the mixing tube from the inlet of the mixing tube, and the fuel and air are mixed in the mixing tube to produce premixed air, which is injected from the outlet of the mixing tube.

CITATION LIST

Patent Literature

Patent Document 1: JP2010-203758A

SUMMARY

Problems to be Solved

In the mixing tube of the fuel/air mixing device described in Patent Document 1, if the plurality of through holes (fuel injection holes) for injecting fuel is provided so as to extend along the radial direction of the mixing tube, the fuel is injected along the radial direction. In this case, the fuel injected from the plurality of fuel injection holes collide with each other in a central portion of an axis perpendicular cross-section of the mixing tube (i.e., in the vicinity of the central axis of the mixing tube), and the fuel concentration in this region tends to be extremely high compared to the surrounding regions. If the fuel concentration distribution is non-uniform in the axis perpendicular cross-section, a region with a high combustion temperature is created, and thus NOx reduction may not be appropriately achieved.

In view of the above, an object of at least one embodiment of the present invention is to provide a burner, a combustor including the same, and a gas turbine whereby it is possible to effectively reduce NOx produced during fuel combustion.

Solution to the Problems (1) A burner according to at least one embodiment of the present invention comprises: at least one mixing tube extending inside a fuel plenum and having an interior configured to be supplied with an air; and a plurality of fuel injection holes for injecting a fuel supplied to the fuel plenum into the interior of the at least one mixing tube. When the at least one mixing tube is viewed in an axial direction of the mixing tube, a central axis of each of the plurality of fuel injection holes is oblique in a same direction with respect to a radial direction of the mixing tube, to a circumferential direction of the mixing tube.

According to the above configuration (1), the fuel injection holes for injecting fuel into the mixing tube are oblique to the radial direction in the same direction with respect to the circumferential direction. As a result, when fuel is injected from the plurality of fuel injection holes, the injected fuel has swirl components in the same direction with respect to the circumferential direction (i.e., clockwise or counterclockwise when viewed in the axial direction). This increases the distance until the fuel injected from the plurality of fuel injection holes collide with each other when viewed in the axial direction of the mixing tube, and increases the proportion of the area used for mixing fuel and air in the cross-section in the axis perpendicular direction, thus promoting the mixing of fuel and air in the mixing tube and suppressing the fuel concentration from becoming locally high in the cross-section to make the fuel concentration distribution uniform. Thus, it is possible to effectively reduce NOx produced during combustion of fuel.

In addition, with the above configuration (1), since the mixing of fuel and air is promoted as described above, the axial distance required for mixing fuel and air can be reduced compared to conventional ones, so that the burner can be downsized.

(2) In some embodiments, in the above configuration (1), the plurality of fuel injection holes is disposed in the at least one mixing tube.

With the above configuration (2), since the fuel injection holes are disposed in the mixing tube itself for supplying fuel into the mixing tube, the mixing of fuel and air in the mixing tube can be promoted as described in the above (1) with a simple configuration, so that it is possible to effectively reduce NOx produced during combustion of fuel.

(3) In some embodiments, in the above configuration (1), the burner further comprises a nozzle member at least partially disposed axially upstream of the mixing tube and forming an upstream space communicating with the fuel plenum. The plurality of fuel injection holes is disposed in the nozzle member.

Generally, the flow passage area upstream of the mixing tube is larger than the flow passage area inside the mixing tube. In this regard, with the above configuration (3), since the nozzle member at least partially disposed upstream of the mixing tube is provided, the axial velocity of air supplied to the mixing tube is relatively low at a position upstream of the mixing tube (e.g., the position of the nozzle member) and relatively high inside the mixing tube. Accordingly, the fuel injected from the fuel injection holes disposed in the nozzle member tends to move closer to the central axis in the radial direction as it advances in the axial direction at a position upstream of the mixing tube. Therefore, the fuel introduced into the mixing tube from the region upstream of the mixing tube is more likely to be away from the wall surface of the mixing tube. Therefore, the fuel concentration near the wall surface of the mixing tube can be easily reduced, and backfires caused by high fuel concentration near the wall surface of the mixing tube can be effectively suppressed.

(4) In some embodiments, in the above configuration (3), the burner comprises an upstream plate and a downstream plate partitioning the fuel plenum. The nozzle member is supported by the upstream plate.

With the above configuration (4), since the nozzle member is supported by the upstream plate partitioning the fuel plenum, the fuel concentration near the wall surface of the mixing tube can be easily reduced as described in the above (3) with a simple configuration, and backfires due to fuel near the wall surface of the mixing tube can be effectively suppressed.

(5) In some embodiments, in the above configuration (3) or (4), the at least one mixing tube includes a plurality of mixing tubes, and the nozzle member includes a plurality of the fuel injection holes configured to inject the fuel into the plurality of mixing tubes, respectively.

With the above configuration (5), since fuel is injected into the plurality of mixing tubes from one nozzle member, the efficiency of fuel supply to the plurality of mixing tubes can be improved, or the efficiency of producing premixed air can be improved.

(6) In some embodiments, in any one of the above configurations (1) to (5), in a cross-section in the axial direction of the at least one mixing tube, the central axis of each of the fuel injection holes is oblique to the radial direction of the mixing tube.

With the above configuration (6), since the fuel injection holes are oblique to the radial direction of the mixing tube, the axial distance until the fuel injected from the fuel injection holes collide with each other can be increased. Thus, the mixing of fuel and air in the mixing tube can be further promoted, so that it is possible to more effectively reduce NOx produced during combustion of fuel.

(7) In some embodiments, in any one of the above configurations (1) to (6), the burner comprises an upstream plate and a downstream plate partitioning the fuel plenum, and the at least one mixing tube is disposed so as to penetrate the upstream plate and the downstream plate.

With the above configuration (7), since the at least one mixing tube is disposed so as to penetrate the upstream plate and the downstream plate, the mixing of fuel and air in the mixing tube can be promoted as described in the above (1) with a simple configuration in which the mixing tube is supported by the upstream plate and the downstream plate partitioning the fuel plenum, so that it is possible to effectively reduce NOx produced during combustion of fuel.

(8) In some embodiments, in any one of the above configurations (1) to (7), the at least one mixing tube includes a plurality of mixing tubes, and the plurality of mixing tubes is disposed so as to extend inside one fuel plenum.

With the above configuration (8), since the plurality of mixing tube is disposed in the fuel plenum partitioned by the upstream plate and the downstream plate, many mixing tubes can be installed in a limited space, so that the burner can be downsized, or the efficiency of producing premixed air in the burner can be improved.

(9) A combustor according to at least one embodiment of the present invention comprises: the burner described in any one of the above (1) to (8); and a combustion liner disposed downstream of the burner.

According to the above configuration (9), the fuel injection holes for injecting fuel into the mixing tube are oblique to the radial direction in the same direction with respect to the circumferential direction. As a result, when fuel is injected from the plurality of fuel injection holes, the injected fuel has swirl components in the same direction with respect to the circumferential direction (i.e., clockwise or counterclockwise when viewed in the axial direction). This increases the distance until the fuel injected from the plurality of fuel injection holes collide with each other when viewed in the axial direction of the mixing tube, and increases the proportion of the area used for mixing in the cross-section in the axis perpendicular direction, thus promoting the mixing of fuel and air in the mixing tube and suppressing the concentration from becoming locally high in the cross-section to make the concentration distribution uniform. Thus, it is possible to effectively reduce NOx produced during combustion of fuel.

In addition, with the above configuration (9), since the mixing of fuel and air is promoted as described above, the axial distance required for mixing fuel and air can be reduced compared to conventional ones, so that the burner can be downsized.

(10) A gas turbine according to at least one embodiment of the present invention comprises the combustor described in the above (9).

According to the above configuration (10), the fuel injection holes for injecting fuel into the mixing tube are oblique to the radial direction in the same direction with respect to the circumferential direction. As a result, when fuel is injected from the plurality of fuel injection holes, the injected fuel has swirl components in the same direction with respect to the circumferential direction (i.e., clockwise or counterclockwise when viewed in the axial direction). This increases the distance until the fuel injected from the plurality of fuel injection holes collide with each other when viewed in the axial direction of the mixing tube, and increases the proportion of the area used for mixing in the cross-section in the axis perpendicular direction, thus promoting the mixing of fuel and air in the mixing tube and suppressing the concentration from becoming locally high in the cross-section to make the concentration distribution uniform. Thus, it is possible to effectively reduce NOx produced during combustion of fuel.

In addition, with the above configuration (10), since the mixing of fuel and air is promoted as described above, the axial distance required for mixing fuel and air can be reduced compared to conventional ones, so that the burner can be downsized.

Advantageous Effects

At least one embodiment of the present invention provides a burner, a combustor including the same, and a gas turbine whereby it is possible to effectively reduce NOx produced during fuel combustion.

DETAILED DESCRIPTION

Embodiments of the present invention will now be described in detail with reference to the accompanying drawings. It is intended, however, that unless particularly identified, dimensions, materials, shapes, relative positions, and the like of components described in the embodiments shall be interpreted as illustrative only and not intended to limit the scope of the present invention.

Figure 1:
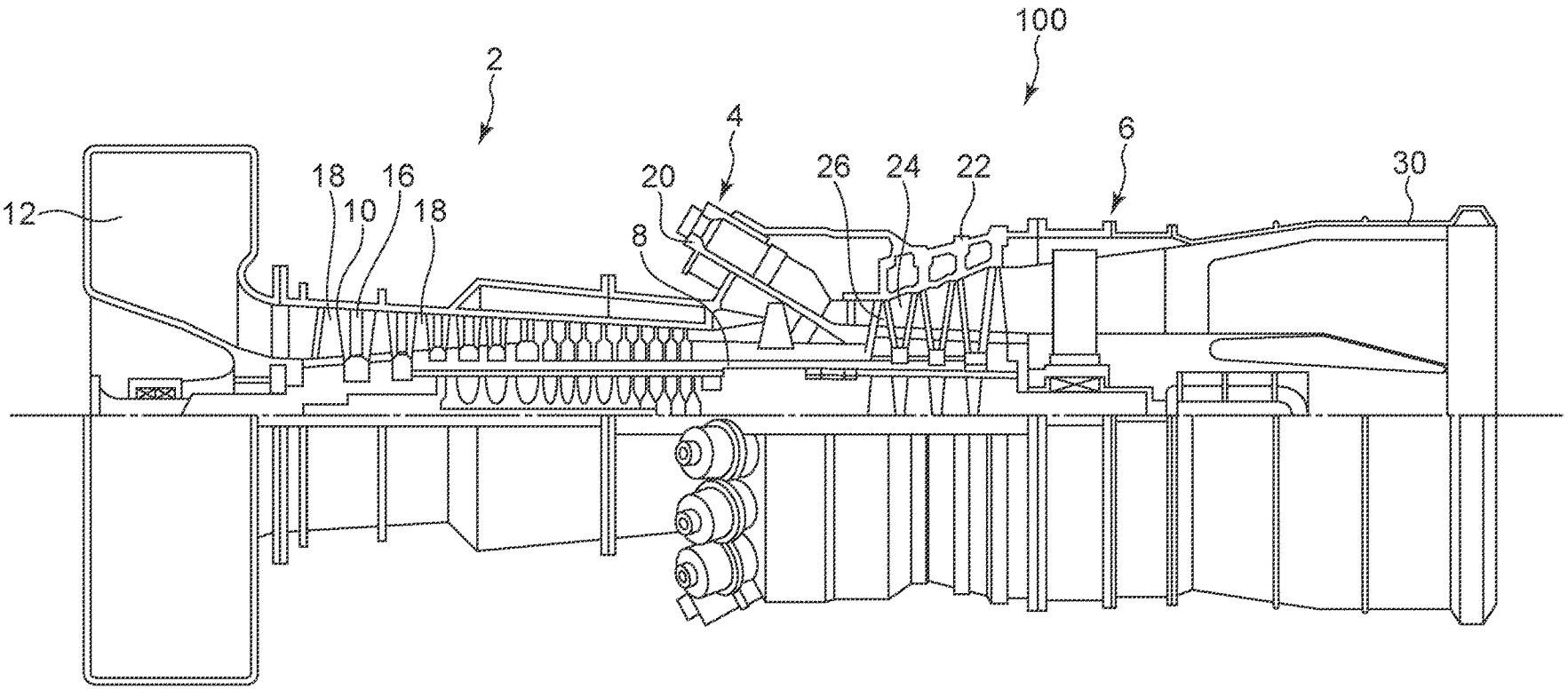
FIG. 1 is a schematic configuration diagram of a gas turbine according to an embodiment.

First, with reference to FIG. 1, a gas turbine, which is an example of application of a burner and a combustor according to some embodiments, will be described. FIG. 1 is a schematic configuration diagram of a gas turbine according to an embodiment. As shown in FIG. 1, the gas turbine 100 includes a compressor 2 for producing compressed air, a combustor 4 for producing combustion gas from the compressed air and fuel, and a turbine 6 configured to be rotationally driven by the combustion gas. In the case of the gas turbine 100 for power generation, a generator (not shown) is connected to the turbine 6.

The compressor 2 includes a plurality of stator blades 16 fixed to a compressor casing 10 and a plurality of rotor blades 18 implanted on a rotor 8 so as to be arranged alternately with the stator blades 16.

To the compressor 2, air sucked in from an air inlet 12 is supplied. The air flows through the plurality of stator blades 16 and the plurality of rotor blades 18 and is compressed into compressed air having a high temperature and a high pressure.

The combustor 4 is supplied with fuel and the compressed air produced in the compressor 2. The combustor 4 combusts the fuel to produce combustion gas that serves as a working fluid of the turbine 6. As shown in FIG. 1, the gas turbine 100 has a plurality of combustors 4 arranged along the circumferential direction around the rotor 8 inside a casing 20.

The turbine 6 includes a plurality of stator blades 24 and a plurality of rotor blades 26 disposed in a combustion gas passage formed by a turbine casing 22. The stator blades 24 and the rotor blades 26 of the turbine 6 are disposed downstream of the combustors 4 with respect to the combustion gas flow.

The stator blades 24 are fixed to the turbine casing 22, and a set of the stator blades 24 arranged along the circumferential direction of the rotor 8 forms a stator blade array. Further, the rotor blades 26 are implanted on the rotor 8, and a set of the rotor blades 26 arranged along the circumferential direction of the rotor 8 forms a rotor blade array. The stator blade arrays and the rotor blade arrays are arranged alternately in the axial direction of the rotor 8.

In the turbine 6, as the combustion gas introduced from the combustor 4 into the combustion gas passage passes through the plurality of stator blades 24 and the plurality of rotor blades 26, the rotor 8 is rotationally driven. Thereby, the generator connected to the rotor 8 is driven to generate power. The combustion gas having driven the turbine 6 is discharged outside via an exhaust chamber 30.

Figure 2:
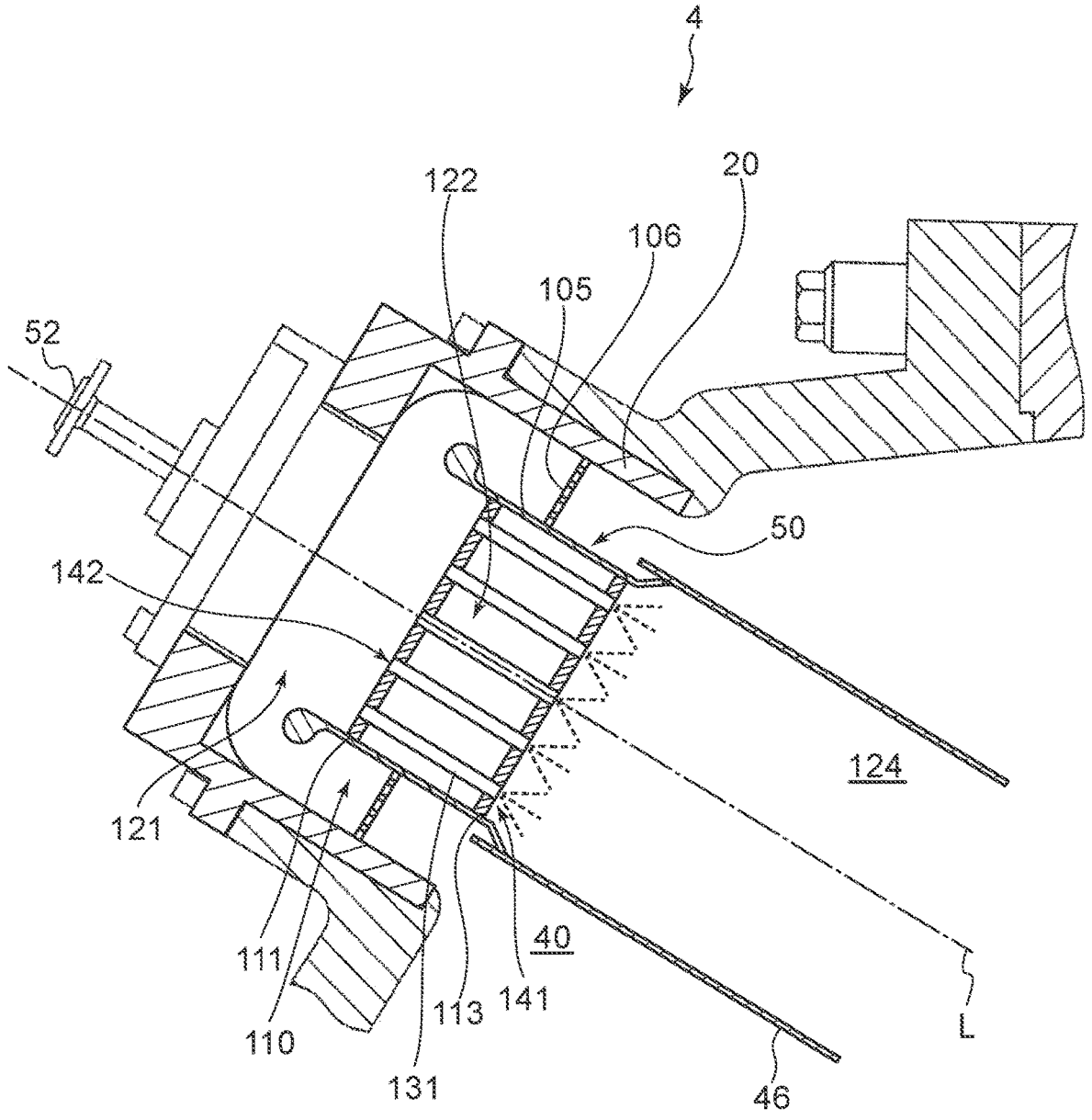
FIG. 2 is a schematic cross-sectional view of a combustor of a gas turbine according to an embodiment.
Figure 3:
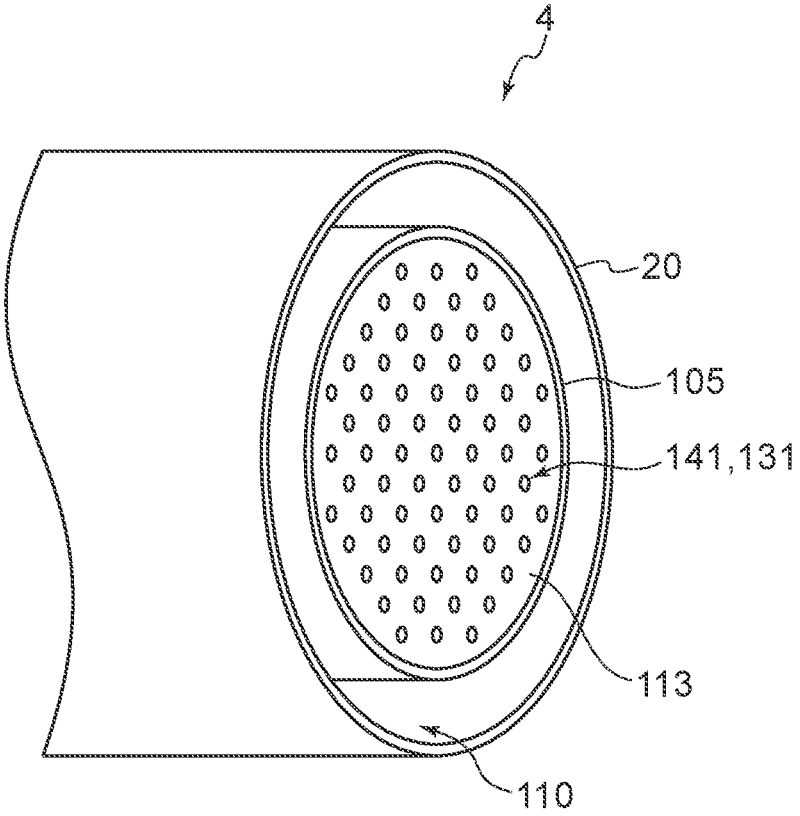
FIG. 3 is a schematic perspective view of a portion in the vicinity of the outlet of a burner of a combustor according to an embodiment when viewed from downstream.

FIG. 2 is a schematic cross-sectional view of the combustor 4 of the gas turbine 100 according to an embodiment. FIG. 3 is a schematic perspective view of a portion in the vicinity of the outlet of a burner 50 of the combustor 4 when viewed from downstream. As shown in FIG. 2, the combustor 4 includes a burner 50 for combusting fuel, and a combustion liner 46 disposed downstream of the burner 50 (i.e., on a side closer to the turbine 6 than the burner 50).

The burner 50 includes a cylindrical member 105 disposed along the axial direction (direction of the axis L of the burner 50), an upstream plate 111 and a downstream plate 113 disposed with a distance in the axial direction, and a mixing tube 131 disposed so as to pass through a fuel plenum 122 which is a space formed between the upstream plate 111 and the downstream plate 113. In the illustrated example, a plurality of mixing tubes 131 is disposed so as to pass through the fuel plenum 122.

The upstream plate 111 and the downstream plate 113 are disposed along a plane perpendicular to the axial direction, and may have a disk shape, for example. The cylindrical member 105 is supported on the casing 20 by a support member 106 disposed around the cylindrical member 105. Each mixing tube 131 extends along the axial direction so as to pass through the upstream plate 111 and the downstream plate 113, and has an inlet 142 at the upstream end and an air-fuel mixture injection hole 141 (see FIG. 3) at the downstream end. In other words, the upstream plate 111 and the downstream plate 113 have through holes in which the mixing tubes 131 are inserted.

Fuel is supplied from a fuel port 52 to the fuel plenum 122 via a fuel passage (not shown), and the supplied fuel is stored in the fuel plenum 122.

Meanwhile, air is supplied to the mixing tube 131. More specifically, an air chamber 121 is formed inside the casing 20 on the upstream side of the burner 50 (i.e., on the opposite side of the burner 50 from the combustion liner 46), and air (compressed air) is introduced into the air chamber 121 from a compartment 40 via an air passage 110 to fill the air chamber 121. Further, the air in the air chamber 121 is supplied to the mixing tube 131 through the inlet 142.

In the mixing tube 131, the fuel supplied from the fuel plenum 122 to the mixing tube 131 and the air supplied to the mixing tube 131 through the inlet 142 are mixed while flowing downstream (i.e., toward the combustion liner 46) to produce a premixed gas. The fuel from the fuel plenum 122 is injected into the mixing tube 131 through fuel injection holes 133 which will be described later. The premixed gas produced in the mixing tube 131 is injected to a combustion chamber 124 formed by the combustion liner 46 through the air-fuel mixture injection hole 141 formed at the downstream end of the mixing tube 131, and is ignited and combusted by a pilot light (not shown).

The burner 50 according to some embodiments will now be described in more detail. The burner 50 described below is applied to the gas turbine 100 and the combustor 4, for example.

Figure 4:
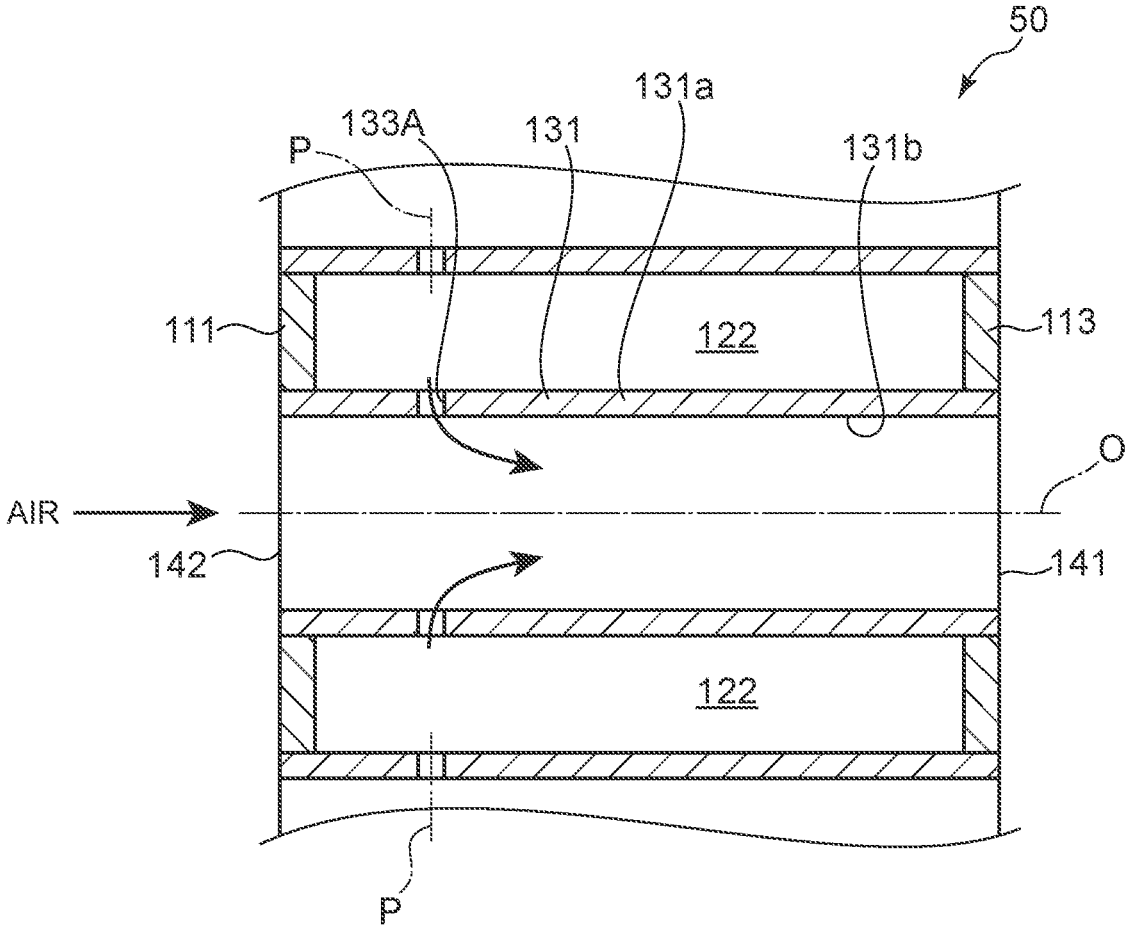
FIG. 4 is a partial cross-sectional view of a burner according to an embodiment, taken along the axial direction.
Figure 5:
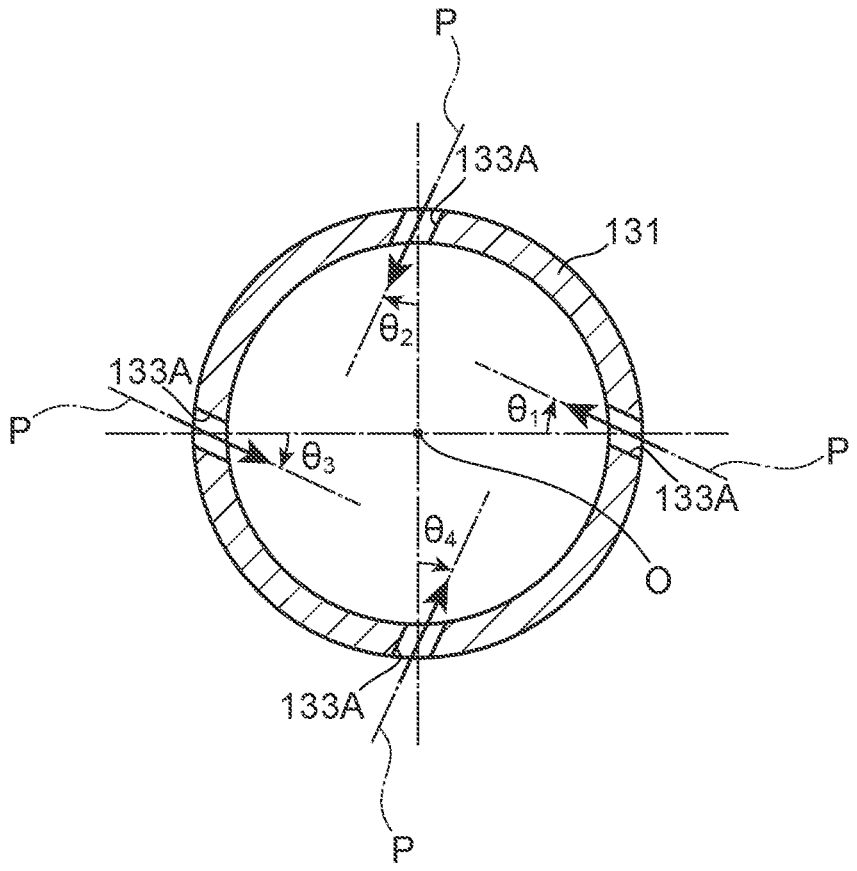
FIG. 5 is a cross-sectional view of a mixing tube of the burner shown in FIG. 4 in the axis perpendicular direction.
Figure 6:
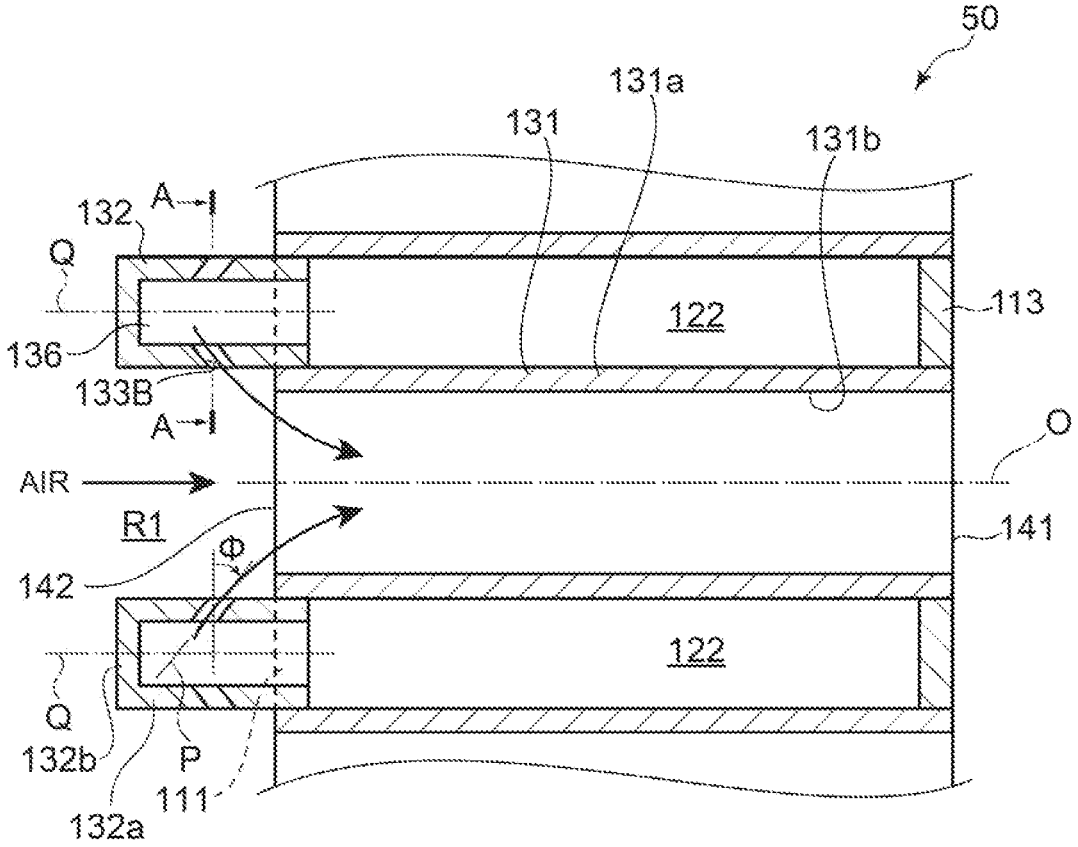
FIG. 6 is a partial cross-sectional view of a burner according to an embodiment, taken along the axial direction.
Figure 7:
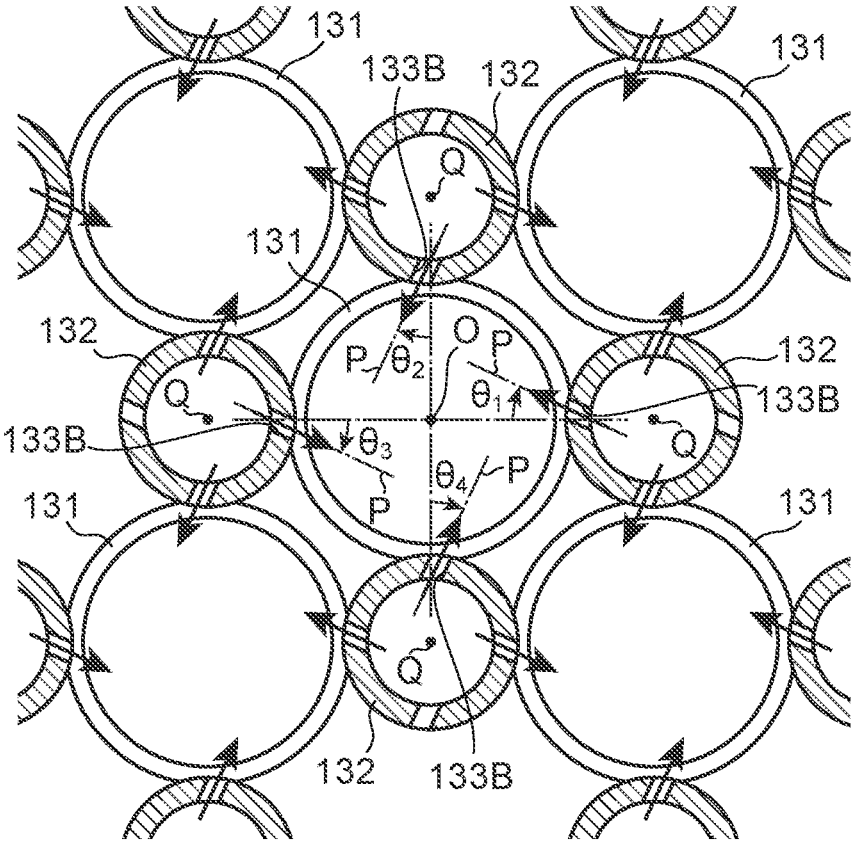
FIG. 7 is a cross-sectional view of a mixing tube of the burner shown in FIG. 6 in the axis perpendicular direction.
Figure 8:
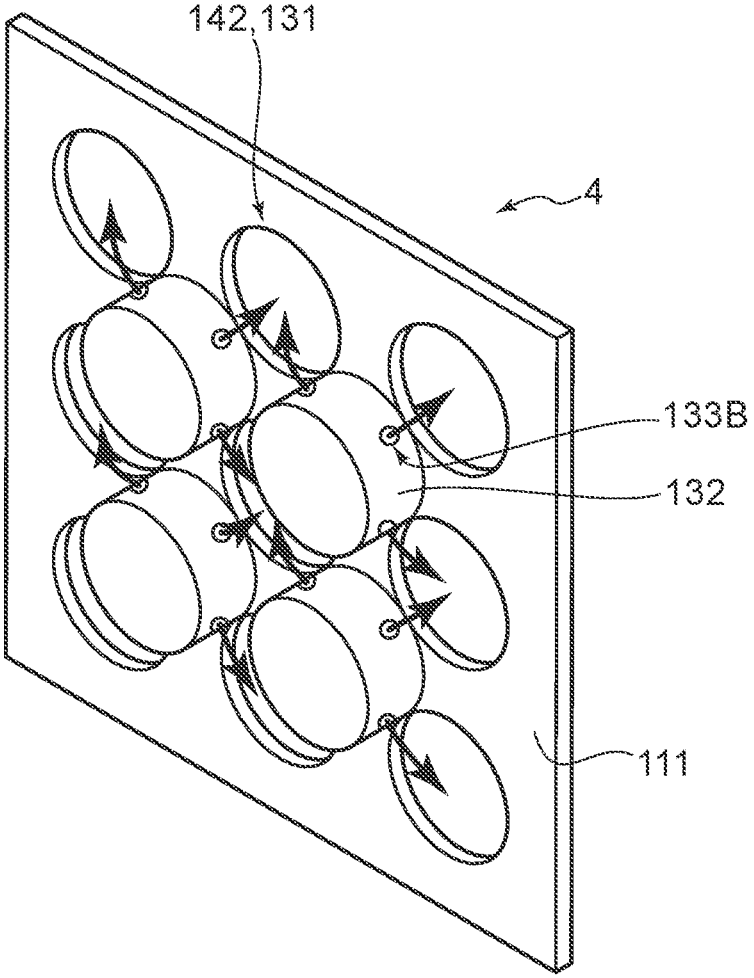
FIG. 8 is a schematic perspective view of a portion in the vicinity of the inlet of the burner shown in FIG. 6 when viewed from upstream.

FIGS. 4 and 6 are a partial cross-sectional view of the burner 50 according to an embodiment, taken along the axial direction. FIGS. 5 and 7 are a cross-sectional view of the mixing tube 131 of the burner 50 shown in FIGS. 4 and 6 in the axis perpendicular direction, respectively. FIG. 8 is a schematic perspective view of a portion in the vicinity of the inlet of the burner 50 shown in FIG. 6 when viewed from upstream.

As described above, the burner 50 has at least one mixing tube 131 extending inside the fuel plenum 122 and having the interior configured to be supplied with air. In the exemplary embodiment shown in FIGS. 4 and 6, the burner 50 has a plurality of mixing tubes 131. Each mixing tube 131 is disposed so as to penetrate the upstream plate 111 and the downstream plate 113 partitioning the fuel plenum 122 and is supported by the upstream plate 111 and the downstream plate 113.

As shown in FIGS. 4 and 6, the burner 50 further includes a plurality of fuel injection holes 133 (133A, 133B) for injecting fuel supplied to the fuel plenum 122 into the mixing tube 131. When the mixing tube 131 is viewed in the axial direction of the mixing tube 131, the central axes P of the fuel injection holes 133 are oblique in the same direction with respect to the circumferential direction of the mixing tube 131, to the radial direction of the mixing tube 131.

More specifically, in the exemplary embodiment shown in FIGS. 4 and 5, the fuel injection holes 133A are through holes disposed in a tube wall 131*a* forming the mixing tube 131, and the fuel injection holes 133A are arranged in one mixing tube 131 at intervals in the circumferential direction. In this embodiment, as shown in FIG. 5, four fuel injection holes 133A are disposed at about 90-degree intervals around the central axis O of the mixing tube 131.

Further, in the exemplary embodiments shown in FIGS. 6 to 8, the burner 50 further includes a nozzle member 132 forming an upstream space 136 communicating with the fuel plenum 122. In this embodiment, the nozzle member 132 includes a cylindrical portion 132*a* partially inserted in a hole formed in the upstream plate 111 forming the fuel plenum 122, and a bottom portion 132*b* closing an open upstream end of the cylindrical portion 132*a*. In other words, the nozzle member 132 is supported by the upstream plate 111 and is partially disposed axially upstream of the mixing tube 131. Further, the upstream space 136 disposed upstream of the mixing tube 131 is formed inside the nozzle member 132.

In this embodiment, as shown in FIG. 7, the fuel injection holes 133B are through holes disposed in the cylindrical portion 132*a* forming the nozzle member 132. Further, the holes are arranged in the nozzle member 132 at intervals in the circumferential direction of the nozzle member 132. More specifically, four fuel injection holes 133B are disposed in one nozzle member 132 at about 90-degree intervals around the central axis Q of the nozzle member 132.

Further, in this embodiment, as shown in FIGS. 7 and 8, multiple nozzle members 132 are disposed around one mixing tube 131 when viewed in the axial direction. More specifically, four nozzle members 132 are disposed around the mixing tube 131 at about 90-degree intervals around the central axis O of the mixing tube 131.

Further, as shown in FIGS. 7 and 8, multiple mixing tubes 131 are disposed around one nozzle member 132 when viewed in the axial direction. More specifically, four mixing tubes 131 are disposed around one nozzle member 132 at about 90-degree intervals around the central axis Q of the nozzle member 132. In other words, when viewed in the axial direction, the mixing tubes 131 and the nozzle members 132 are arranged in a staggered pattern.

Further, each nozzle member 132 is configured to inject fuel through the fuel injection holes 133B into the mixing tubes 131 disposed around the nozzle member 132, respectively.

In these embodiments, when viewed in the axial direction, the fuel injection holes 133 (133A, 133B) disposed around one mixing tube 131 are oblique to the radial direction of the mixing tube 131 in the same direction with respect to the circumferential direction of the mixing tube 131. In other words, as shown in FIGS. 5 and 7, the central axes P of the fuel injection holes 133 (133A, 133B) disposed around the mixing tube 131 are oblique in the same direction with respect to the circumferential direction of the mixing tube 131 to the radial direction of the mixing tube 131 by θ1, θ2, θ3, and θ4, respectively (θ1 to θ4 are greater than 0 degrees). Typically, the angles θ1, θ2, θ3, and θ4 are substantially the same.

With the burner 50 having the above configuration, the fuel injection holes 133 (133A, 133B) for injecting fuel into the mixing tube 131 are oblique to the radial direction in the same direction with respect to the circumferential direction. As a result, when fuel is injected from the fuel injection holes 133, the injected fuel has swirl components in the same direction with respect to the circumferential direction (i.e., clockwise or counterclockwise in FIGS. 5 and 7). This increases the distance until the fuel injected from the fuel injection holes 133 collide with each other when viewed in the axial direction of the mixing tube 131, and increases the proportion of the area used for mixing fuel and air in the cross-section in the axis perpendicular direction, thus promoting the mixing of fuel and air in the mixing tube 131 and suppressing the fuel concentration from becoming locally high in the cross-section to make the fuel concentration distribution uniform. Thus, it is possible to effectively reduce NOx produced during combustion of fuel.

Figure 9:
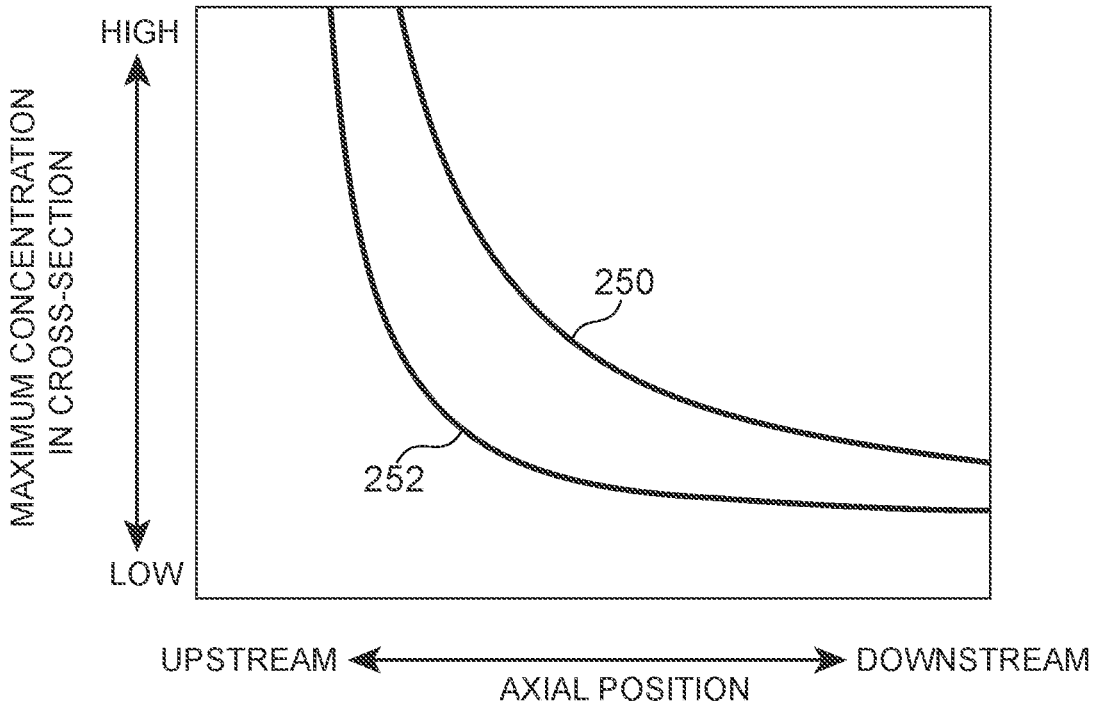
FIG. 9 is a graph showing an example of a relationship between the axial position in the mixing tube and the maximum value of fuel concentration in an axis perpendicular cross-section at the axial position.

FIG. 9 is a graph showing an example of a relationship between the axial position in the mixing tube 131 (horizontal axis) and the maximum value of fuel concentration in an axis perpendicular cross-section at the axial position (maximum concentration in cross-section; vertical axis). The curve 250 in the graph indicates the case where the central axes P of the fuel injection holes 133 are not oblique to the radial direction in the axial view (i.e., the inclination angle θ (see FIGS. 5 and 7) of the central axis P with respect to the radial direction is 0 degrees), and the curve 252 indicates the case where the central axes P of the fuel injection holes 133 are oblique to the radial direction in the axial view (i.e., the inclination angle θ is greater than 0 degrees). In the graph of FIG. 9, compared to the curve 250, the curve 252 has a lower maximum concentration in the cross-section on the upstream side, i.e., the fuel concentration distribution is more uniform on the upstream side, which indicates a better mixing condition.

As described above, in the above-described embodiments in which the central axes P of the fuel injection holes 133 are oblique to the radial direction, compared to the case where the central axes P of the fuel injection holes 133 are not oblique to the radial direction, the axial distance required for mixing air and fuel can be reduced. Therefore, the length of the mixing tube 131 can be shortened, and the burner 50 can be downsized. Thus, the axial lengths of the mixing tube 131 and the cylindrical member 105 can be reduced, and the manufacturing cost of the burner 50 can be reduced. Further, since the mixing tube 131 and the cylindrical member 105 are shortened, the frequency range of unstable vibrations that can occur in these components is limited, thus reducing combustion vibrations.

The inclination angle θ of the central axis P of each of the fuel injection holes 133 to the radial direction of the mixing tube 131 may be not less than 15 degrees and not more than 55 degrees.

As described above, in the exemplary embodiments shown in FIGS. 6 to 8, the fuel injection holes 133B are formed in the nozzle member 132 which is at least partially disposed upstream of the mixing tube 131. Further, as shown in FIG. 6, since the nozzle member 132 is disposed radially outward of the mixing tube 131, the flow passage area of the region R1 upstream of the mixing tube 131 (the axial position where the nozzle member 132 is arranged) is larger than the flow passage area inside the mixing tube 131.

Thus, in the embodiments shown in FIGS. 6 to 8, the axial velocity of air supplied to the mixing tube 131 is relatively low at a position (region R1) upstream of the mixing tube 131 and relatively high inside the mixing tube 131. Accordingly, the fuel injected from the fuel injection holes 133B disposed in the nozzle member 132 tends to move closer to the central axis O of the mixing tube 131 in the radial direction as it advances in the axial direction at a position (region R1) upstream of the mixing tube 131. Therefore, the fuel introduced into the mixing tube 131 from the region upstream of the mixing tube 131 is more likely to be away from the wall surface 131*b* (the inner peripheral surface of the tube wall 131*a*) of the mixing tube 131. Therefore, the fuel concentration near the wall surface of the mixing tube 131 can be easily reduced, and backfires caused by high fuel concentration near the wall surface of the mixing tube 131 can be effectively suppressed.

In some embodiments, for example as shown in FIG. 6, in a cross-section taken along the axial direction of the mixing tube 131, the central axis P of each of the fuel injection holes 133B is oblique to the radial direction of the mixing tube 131. In other words, in the example shown in FIG. 6, the angle φ between the central axis P of each of the fuel injection holes 133B and the radial direction of the mixing tube 131 is greater than 0 degrees.

In this case, the axial distance until the fuel injected from the fuel injection holes 133B collide with each other can be increased. Thus, the mixing of fuel and air in the mixing tube 131 can be further promoted, so that it is possible to more effectively reduce NOx produced during combustion of fuel.

In some embodiments, for example as shown in FIG. 4, in a cross-section including the axial direction of the mixing tube 131, the central axis P of the fuel injection hole 133B may extend along the direction perpendicular to the central axis O of the mixing tube 131. In other words, in a cross-section in the axial direction of the mixing tube 131, the central axis P of the fuel injection hole 133 may not be oblique to the radial direction of the mixing tube 131.

Further, in some embodiments, some mixing tubes 131 constituting the burner 50 may have a fuel injection hole whose central axis extends along the radial direction when viewed in the axial direction of the mixing tube 131. In other words, when viewed in the axial direction of the mixing tube 131, the central axis of this fuel injection hole may not be oblique to the radial direction of the mixing tube 131 with respect to the circumferential direction of the mixing tube 131.

Embodiments of the present invention were described in detail above, but the present invention is not limited thereto, and various amendments and modifications may be implemented.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function. For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

REFERENCE SIGNS LIST

2 Compressor
4 Combustor
6 Turbine
8 Rotor
10 Compressor casing
12 Air inlet
16 Stator blade
18 Rotor blade
20 Casing
22 Turbine casing
24 Stator blade
26 Rotor blade
30 Exhaust chamber
40 Compartment
46 Combustion liner
50 Burner
52 Fuel port
100 Gas turbine
105 Cylindrical member
106 Support member
110 Air passage
111 Upstream plate
113 Downstream plate
121 Air chamber
122 Fuel plenum
124 Combustion chamber
131 Mixing tube
131*a* Tube wall
131*b* Wall surface
132 Nozzle member
132*a* Cylindrical portion
132*b* Bottom portion
133, 133A, 133B Fuel injection hole
136 Upstream space
141 Air-fuel mixture injection hole
142 Inlet
L Axis
O Central axis
P Central axis
R1 Region

The invention claimed is:

1. A burner, comprising:

a mixing tube extending inside a fuel plenum along an axis of the burner and having an interior configured to be supplied with an air defining an upstream direction and a downstream direction, the mixing tube having an inlet through which the air is introduced into the mixing tube;

an upstream plate and a downstream plate defining the fuel plenum;

a plurality of nozzle members supported by the upstream plate so as to be at least partially disposed axially upstream of the mixing tube, the plurality of nozzle members each forming a respective upstream space communicating with the fuel plenum; and a plurality of fuel injection holes for injecting a fuel from the fuel plenum into the interior of the mixing tube, each of the plurality of fuel injection holes being disposed on a respective one of the plurality of nozzle members, wherein each of the plurality of fuel injection holes is disposed axially upstream of the upstream plate and axially upstream of the inlet of the mixing tube, wherein each of the plurality of nozzle members includes:

a cylindrical portion disposed axially upstream of the upstream plate; and a bottom portion closing an axially upstream end of the cylindrical portion, and wherein for each of the plurality of nozzle members, an inner peripheral wall surface of the cylindrical portion and an axially downstream wall surface of the bottom portion together form the respective upstream space.

2. The burner according to claim 1, wherein the mixing tube includes a plurality of mixing tubes, wherein each of the plurality of nozzle members are supported by the upstream plate so as to be at least partially disposed axially upstream of each of the plurality of mixing tubes, and wherein each of the plurality of fuel injection holes disposed on the respective one of the plurality of nozzle members includes multiple fuel injection holes, each fuel injection hole of the multiple fuel injection holes being configured to inject the fuel into a respective one of the plurality of mixing tubes that is adjacent to the fuel injection hole.

3. The burner according to claim 1, wherein, in an axial cross-section of the mixing tube, a central axis of each of the plurality of fuel injection holes is oblique relative to a radial direction of the mixing tube.

4. The burner according to claim 1, wherein the mixing tube is disposed so as to penetrate the upstream plate and the downstream plate.

5. The burner according to claim 1, wherein the mixing tube includes a plurality of mixing tubes, wherein each of the plurality of nozzle members are supported by the upstream plate so as to be at least partially disposed axially upstream of each of the plurality of mixing tubes, and wherein each of the plurality of mixing tubes is disposed so as to extend inside the fuel plenum.

6. A combustor, comprising:

the burner according to claim 1; and a combustion liner disposed downstream of the burner.

7. A gas turbine, comprising the combustor according to claim 6.

8. The burner according to claim 1, wherein, when the mixing tube is viewed in an axial direction of the mixing tube, a central axis of each of the plurality of fuel injection holes is oblique to a radial direction of the mixing tube toward a same direction relative to a circumferential direction of the mixing tube.

* * * * *